US012800216B2

(12) United States Patent
Ye

(10) Patent No.: US 12,800,216 B2
(45) Date of Patent: Nov. 17, 2026

(54) REFRIGERATOR

(71) Applicant: LG ELECTRONICS INC., Seoul (KR)

(72) Inventor: Kwangyoung Ye, Seoul (KR)

(73) Assignee: LG Electronics Inc., Seoul (KR)

( * ) Notice: Subject to any disclaimer, the term of this patent is extended or adjusted under 35 U.S.C. 154(b) by 210 days.

(21) Appl. No.: 18/039,157

(22) PCT Filed: Nov. 24, 2021

(86) PCT No.: PCT/KR2021/017358
§ 371 (c)(1),
(2) Date: May 26, 2023

(87) PCT Pub. No.: WO2022/114761
PCT Pub. Date: Jun. 2, 2022

(65) Prior Publication Data

US 2023/0417473 A1 Dec. 28, 2023

(30) Foreign Application Priority Data

Nov. 27, 2020 (KR) ..... 10-2020-0163045

(51) Int. Cl.
*F25D 17/06* (2006.01)
*F25D 23/12* (2006.01)

(52) U.S. Cl.
CPC ..... *F25D 17/062* (2013.01); *F25D 23/12* (2013.01); *F25D 2317/063* (2013.01)

(58) Field of Classification Search
CPC .. F25D 17/062; F25D 23/12; F25D 2317/063; F25D 2317/061
See application file for complete search history.

(56) References Cited

U.S. PATENT DOCUMENTS 6,732,537 B1 * 5/2004 Anell ..... F25D 17/065 62/353
10,101,074 B2 10/2018 Morgan et al.
(Continued)

FOREIGN PATENT DOCUMENTS

EP 4249833 A1 9/2023
JP 2001002568 1/2001
(Continued)

OTHER PUBLICATIONS

Machine English language translation of JP5586534 to Inoguchi. Translated Apr. 2026 (Year: 2014).*
(Continued)

*Primary Examiner* — Cassey D Bauer
(74) *Attorney, Agent, or Firm* — Fish & Richardson P.C.

(57) ABSTRACT

A refrigerator includes cabinet forming a storage space; a door for opening/closing the storage space, a grille panel forming the rear surface of the storage space and having an outlet through which cold air is discharged, an icemaker disposed in front of the outlet to make ice, and a top cover disposed between the icemaker and the upper surface of the storage space, wherein the top cover has a cover flow channel which is open in the back-and-forth direction above the icemaker and guides a part of cold air discharged through the outlet to the front of the icemaker.

16 Claims, 15 Drawing Sheets

(56) References Cited

U.S. PATENT DOCUMENTS

| | | | | |
|---|---|---|---|---|
| 2007/0084229 | A1* | 4/2007 | Han | F25D 17/065 62/340 |
| 2017/0307281 | A1* | 10/2017 | Morgan | F25C 5/185 |
| 2019/0011166 | A1* | 1/2019 | Bertolini | F25C 5/22 |

FOREIGN PATENT DOCUMENTS

| | | | | |
|---|---|---|---|---|
| JP | 5586534 | B2 * | 9/2014 | F25D 17/08 |
| KR | 20070042020 | | 4/2007 | |
| KR | 20100013724 | | 2/2010 | |
| KR | 101406187 | | 6/2014 | |
| KR | 20190053740 | | 5/2019 | |
| KR | 20190125121 | | 11/2019 | |
| WO | WO-2017176073 | A2 * | 10/2017 | F25C 1/24 |

OTHER PUBLICATIONS

Machine English language translation of WO2017/176073 to Hong et al. Translated Apr. 2026 (Year: 2017).*

Extended European Search Report in European Appln. No. 21898587.7, mailed on Sep. 4, 2024, 8 pages.

* cited by examiner

REFRIGERATOR

CROSS-REFERENCE TO RELATED APPLICATIONS

This application is a National Stage application under 35 U.S.C. § 371 of International Application No. PCT/KR2021/017358, filed on Nov. 24, 2021, which claims the benefit of and priority to Korean Patent Application No. 10-2020-0163045, filed on Nov. 27, 2020. The disclosures of the prior applications are incorporated by reference in their entirety.

FIELD

The present disclosure relates to a refrigerator.

DESCRIPTION OF RELATED ART

In general, a refrigerator is a home appliance that allows food to be stored at a low temperature in an internal storage space shielded by a refrigerator door. The refrigerator is constructed to keep the stored food in an optimal condition by cooling the inside of the storage space using cold air generated via heat exchange with a refrigerant circulating in a refrigeration cycle.

Such refrigerators are gradually becoming larger and more multifunctional in accordance with a trend of changing dietary habits and upgrading products, and refrigerators with various structures and convenience devices in consideration of user's convenience are being released.

In particular, recently, there is a refrigerator equipped with an automatic ice maker capable of automatically making and storing ice.

Representatively, Korean Patent Application Publication No. 10-2010-013724 discloses a structure in which the ice maker is disposed in a freezing compartment, and ice is made by automatically supplied water and then dropped downward to be stored.

However, in a refrigerator with such a structure, a discharge port through which cold air is discharged may not be obscured depending on an arrangement of the ice maker. Thus, there is a problem in that cold air cannot be supplied to a space in front of the ice maker.

Therefore, there is a problem in that circulation and supply of cold air throughout the storage space is not smooth. In particular, when an accommodation member is disposed in the space in front of the ice maker, the supply of cold air is not smooth, resulting in poor storage performance.

DISCLOSURE

Technical Purpose

An implementation of the present disclosure is to provide a refrigerator in which cold air circulation inside a freezing compartment is improved while satisfying a cooling performance of an ice maker at the same time.

An implementation of the present disclosure is to provide a refrigerator capable of supplying cold air toward an accommodation member located in front of an ice maker by bypassing the ice maker.

An implementation of the present disclosure is to provide a refrigerator capable of cooling the inside of the refrigerator, and at the same time, effectively cooling an ice maker using one cold air discharge port.

An implementation of the present disclosure is to provide a refrigerator that prevents cold air penetration to a bottom surface of a refrigerating compartment.

Technical Solution

A refrigerator according to an implementation of the present disclosure includes: a cabinet for defining a storage space therein; a door for opening and closing the storage space; a grille panel forming a rear surface of the storage space and having a discharge port for discharging cold air; an ice maker disposed in front of the discharge port and making ice; and a top cover disposed between the ice maker and a top surface of the storage space, and a cover passage opened in a front and rear direction from above the ice maker and guiding a portion of cold air discharged from the discharge port to a space in front of the ice maker is defined in the top cover.

The ice maker may include: an ice tray formed with multiple cells where water is accommodated and ice is formed; and a casing for forming an outer appearance of the ice maker and accommodating the ice tray therein, and an ice maker inlet for introducing cold air into the casing may be defined at one side of the casing facing the discharge port.

The top cover may shield at least a portion of an open top surface of the casing, and a cover passage inlet for introducing cold air into the cover passage may be defined at one side of the top cover facing the discharge port.

A guide duct for guiding cold air discharged from the discharge port to the ice maker and the top cover may be disposed between the ice maker and the discharge port, and an inside of the guide duct may be branched in a vertical direction, and branched outlets of the guide duct may open toward the cover passage and the ice maker inlet, respectively.

A portion of the discharge port may be shielded by the guide duct and a remaining portion of the discharge port may extend laterally beyond the ice maker so as to be exposed to the storage space.

The guide duct may include: a duct body having open front surface and rear surface; and a duct partition for partitioning an inner space of the duct body in the vertical direction so as to define an upper passage and a lower passage, an outlet of the upper passage may be defined at a position facing a cover passage inlet, and an outlet of the lower passage may be defined at a position facing the ice maker inlet.

Multiple upper grilles for guiding cold air discharged from the discharge port toward the cover passage may be formed in the upper passage, multiple lower grilles for guiding cold air discharged from the discharge port into the ice maker may be formed in the lower passage, and the upper grille and the lower grille may be inclined in different directions.

The guide duct may include a duct edge extending outward from a rear end of the duct body and supported on a grille panel front surface, and one end of the duct edge may include a discharge port-receiving portion cut so as to receive therein a portion of the discharge port having a protruding shape.

The top surface of the storage space may define an upwardly recessed space, and at least a portion of the top cover may be accommodated inside the recessed space.

The top cover may include: a pair of side ribs extending in the front and rear direction on a top surface of the top cover and spaced apart from each other; and a duct cover for connecting upper ends of the side ribs to each other, and the cover passage may be defined by the top surface of the top cover, the side ribs, and the duct cover.

The duct cover may be made of a plate-shaped heat insulating material.

A distance between the side ribs may become greater in a direction toward an outlet of the cover passage.

Multiple discharge grilles protruding from the top cover top surface may be formed at a space spaced forwardly apart from the outlet of the cover passage, and the discharge grilles may be formed inclined so as to intersect an extending direction of the cover passage.

A discharge guide extending from front ends of the side ribs to the discharge grilles and inclined downward may be defined in the top cover.

A door basket may be disposed on a rear surface of the door, and an outlet of the cover passage may be opened toward the door basket.

Technical Effect

Following effects may be expected from the proposed refrigerator according to the implementation.

In the refrigerator according to the implementation of the present disclosure, the top cover is coupled to the ice maker, so that cold air discharged from the discharge port at the rear bypasses the ice maker upward and is discharged forwardly of the ice maker.

Therefore, there is an advantage in that cold air may be smoothly supplied to the space in front of the ice maker even in the structure in which the ice maker obscures the discharge port from the front.

In particular, when the door basket is disposed on the freezing compartment door, air that has passed through the ice maker may be allowed to be directed toward the door basket, thereby improving the cooling performance of the door basket.

By allowing cold air to be discharged to the space in front of the ice maker, cold air may be supplied to the entire freezing compartment, and a uniform temperature may be maintained and the circulation of cold air may be achieved in the entire freezing compartment, thereby guaranteeing securing the cooling performance.

In addition, the guide duct may be disposed between the discharge port of the grille panel and the ice maker, and the flow of cold air discharged from the discharge port may be split into the upper passage and the lower passage of the guide duct and then directed to the cover passage and the ice maker.

Cold air sequentially passing through the upper passage and the cover passage and bypassing the ice maker may cool the rear surface of the freezing compartment door and the door basket, and cold air sequentially passing through the lower passage and the ice maker passage may be supplied to the ice maker, so that the ice making may be effectively performed in the ice maker.

That is, the ice making inside the ice maker and the cooling of the space in front of the ice maker may be performed at the same time because of the arrangement of the ice maker, so that an ice making performance and the cooling performance may be guaranteed.

In addition, the discharge grille is disposed at the outlet of the cover passage to enable intensive supply of cold air to a specific position of the space in front of the ice maker, for example, the door basket, so that the cooling performance may be satisfied even with a low flow rate of cold air.

In addition, the inlet guide and the outlet guide may be formed at positions adjacent to the inlet and the outlet of the cover passage, thereby facilitating the inflow of cold air from the guide duct and facilitating the discharge of cold air from the cover passage to facilitate the flow of cold air.

In addition, the cover passage has the structure in which the insulating plate is coupled to the upper ends of the pair of side ribs integrally molded with the top cover, so that the molding of the top cover may be facilitated and the cover passage may be easily defined.

In one example, the cover passage is defined above the ice maker, and the barrier on which the ice maker is disposed is recessed upward, so that the barrier may be locally thinned. However, because the top surface of the cover passage is formed by the insulating plate, the temperature of the barrier top surface, that is, the bottom surface of the refrigerating compartment may be prevented from being lowered by cold air passing through the inside of the cover passage.

Therefore, even with the arrangement of the ice maker and the definition of the cover passage, the lowering of the temperature of the bottom surface of the refrigerating compartment may be prevented and the insulation performance may be maintained. In addition, there is an advantage of ensuring sufficient insulation performance even when the accommodation portion is defined in the barrier.

DETAILED DESCRIPTIONS

Hereinafter, a specific implementation of the present disclosure will be described in detail with drawings. However, the present disclosure may not be limited to the implementation in which the idea of the present disclosure is presented, and other implementations that fall within the scope of the present disclosure may be easily suggested by adding, changing, or omitting components.

Directions are defined prior to description. In the implementation of the present disclosure, a direction in which a door shown in FIG. 1 is facing may be defined as a forward direction, and, based on the door, a direction toward a cabinet, a direction toward a floor on which a refrigerator is installed, and a direction away from the floor may be defined as a rearward direction, a downward direction, and an upward direction, respectively.

Figure 1:
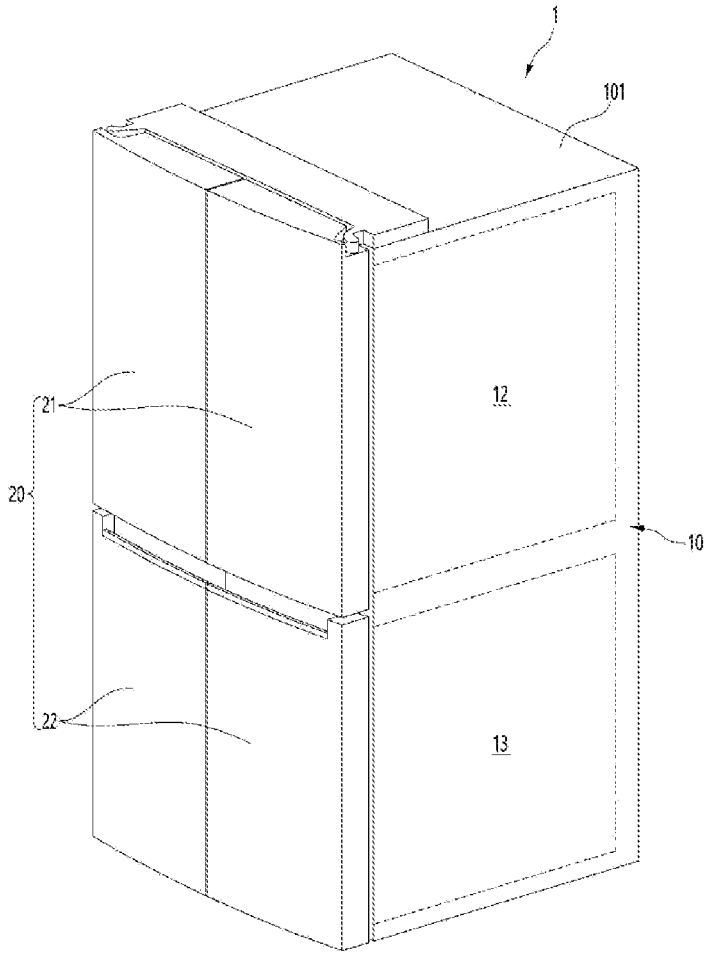
FIG. 1 is a perspective view of a refrigerator according to an implementation of the present disclosure.
Figure 2:
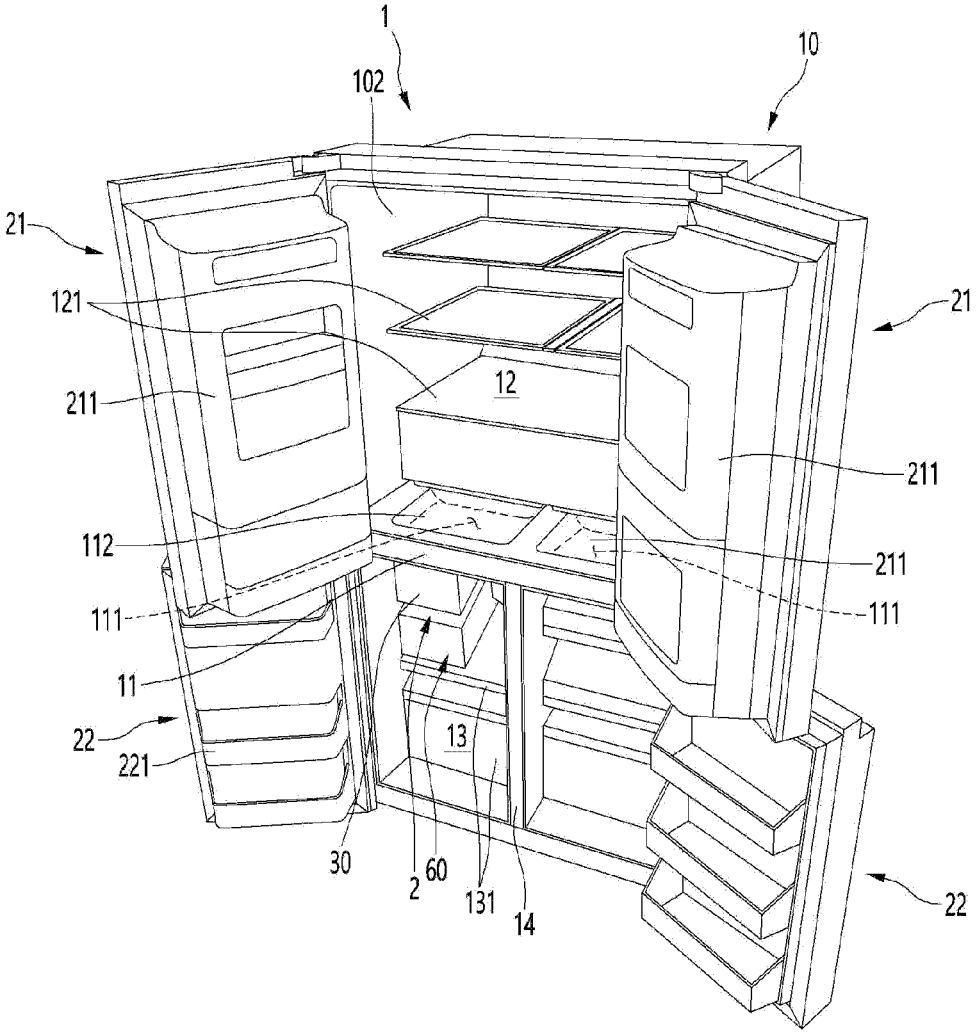
FIG. 2 is a perspective view in which doors of the refrigerator are opened.
Figure 3:
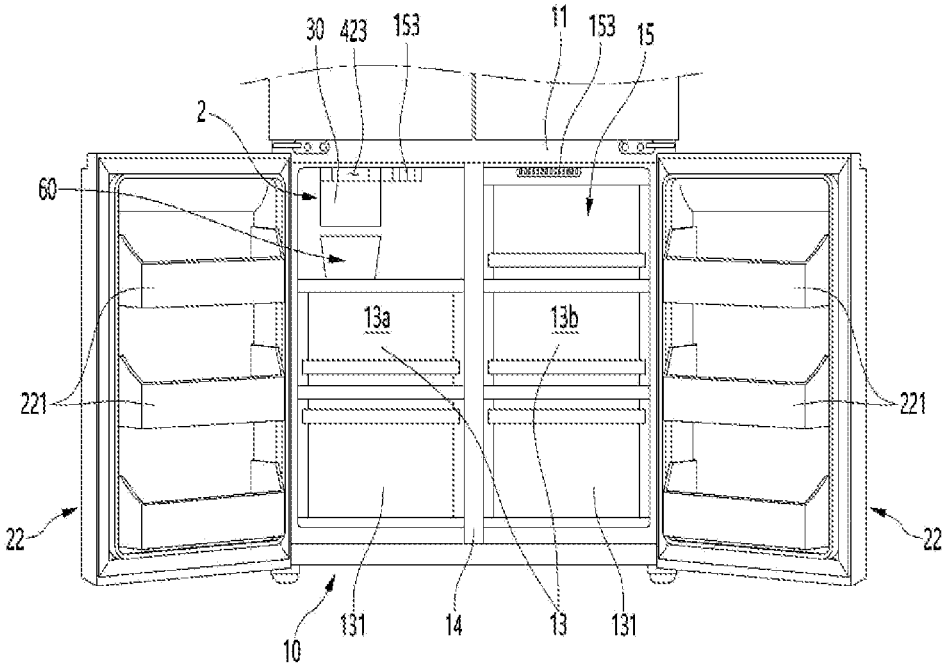
FIG. 3 is a front view in which lower doors of the refrigerator are opened.

FIG. 1 is a perspective view of a refrigerator according to an implementation of the present disclosure. In addition, FIG. 2 is a perspective view in which doors of the refrigerator are opened. FIG. 3 is a front view in which lower doors of the refrigerator are opened.

As shown in the drawing, a refrigerator 1 according to an implementation of the present disclosure may include a cabinet 10 for defining a storage space therein, and a door 20 that is mounted on an open front surface of the cabinet 10 to open and close the storage space.

The cabinet 10 may include an outer casing 101 for forming an outer appearance thereof, an inner casing 102 for defining the storage space therein, and an insulation material 103 (in FIG. 14) filled between the outer casing 101 and the inner casing 102.

The cabinet 10 may include a barrier 11, and the storage space may be partitioned vertically by the barrier 11. Accordingly, the storage space may be divided into an upper storage space 12 and a lower storage space 13. For example, the upper storage space 12 may be used as a refrigerating compartment that is frequently used because it is easily accessible by a user, and the lower storage space 13 may be used as a freezing compartment. Accordingly, the upper storage space 12 may be referred to as a refrigerating compartment 12 and the lower storage space 13 may be referred to as a freezing compartment 13.

The door 20 may include an upper door 21 for shielding the upper storage space 12 and a lower door 22 for shielding the lower storage space 13. The upper door 21 may be referred to as a refrigerating compartment door 21, and the lower door 22 may be referred to as a freezing compartment door 22.

The upper door 21 may include a pair of upper doors, and the pair of upper doors may independently pivot to open and close the upper storage space 12. The upper door 21 may be of a French type and may partially open and close the upper storage space 12 independently.

In addition, the upper door 21 may be constructed in a form of a double door composed of a main door having an opening defined therein and a sub door pivotably disposed in front of the main door to open and close the opening.

A door accommodation member 211 having a basket or a separate accommodation space may be further disposed on a rear surface of the upper door 21, that is, a surface facing the refrigerating compartment 12.

Like the upper door 21, the lower door 22 may include a pair of lower doors on both left and right sides, and the pair of lower doors may open and close the lower storage space 13. In addition, the lower door 22 may be referred to as the freezing compartment door 22.

In addition, a door basket 221 may be disposed on a rear surface of the lower door 22, that is, a surface facing the freezing compartment 13. Multiple door baskets 221 may be disposed so as to be spaced apart from each other vertically. In addition, the door basket 221 may be detachably provided. In addition, the door basket 221 may have a structure that may be accommodated by a shape of the rear surface of the lower door 22, rather than the detachable form.

A refrigerating compartment accommodation member 121 like a drawer and a shelf may be disposed inside the refrigerating compartment 12. Multiple refrigerating compartment accommodation members 121 may be disposed vertically, or may be disposed side by side on both left and right sides.

A recessed accommodation portion 111 may be further defined in a bottom surface of the refrigerating compartment 12. The accommodation portion 111 may be recessed downward in a top surface of the barrier 11, and an accommodation space may be defined in the space recessed by the storage portion 111, that is, a recessed area of the barrier 11. The accommodation portion 111 may be recessed, but may be recessed to a depth for a bottom surface of the barrier 11 corresponding to a position of the accommodating portion 111 not to protrude downward.

In addition, the accommodation portion 111 may be located at a front end of the bottom surface of the refrigerating compartment 12, and may be defined forwardly of the refrigerating compartment accommodation member 121 so as to be easily accessible by a user and so as not to be obscured by the refrigerating compartment accommodation member 121. In addition, an accommodation portion cover 112 capable of opening and closing an open top surface of the accommodation portion 111 may be further disposed on the accommodation portion 111.

A freezing compartment accommodation member 131 may be disposed inside the freezing compartment 13. For example, the freezing compartment accommodation member 131 may be constructed as a drawer that may be retracted and extended, and multiple freezing compartment accommodation members may be disposed vertically. The retracting/extending structure of the freezing compartment accommodation member 131 may facilitate accommodation of food in the freezing compartment 13 located at a lower side.

The freezing compartment 13 may have a freezing compartment barrier 14 partitioning the freezing compartment 13 in a left and right direction. The freezing compartment barrier 14 may be disposed at a center of the freezing compartment 13 in a horizontal direction, and may extend from the bottom surface of the barrier 11 to a bottom surface of the freezing compartment 13. In addition, each space partitioned by the barrier 11 may be opened and closed by each of the pair of the freezing compartment doors 22.

An ice maker 30 may be disposed inside the freezing compartment 13. The ice maker 30 may be disposed on a top surface of the freezing compartment 13 and may be exposed forward when the freezing compartment door 22 is opened. The ice maker 30 may be disposed only in a space 13*a* on one side among spaces 13*a* and 13*b* on both left and right sides divided from each other in the freezing compartment 13.

The ice maker 30 may be constructed such that water supply, ice making, and ice transferring are performed automatically, and may be referred to as an automatic ice maker. An ice bin 60 may be disposed below the ice maker 30. The ice bin 60 may be formed in a basket shape in which ice made by the ice maker 30 is stored after being dropped. In addition, the ice bin 60 may be mounted on the freezing compartment accommodation member 131, and retracted and extended together with the freezing compartment accommodation member 131.

The ice maker 30 may make ice by cold air supplied into the freezing compartment 13. Accordingly, the ice maker 30 may have a structure to which cold air is easily supplied. In addition, the inside of the freezing compartment 13 may have a structure in which cold air is easily supplied into the ice maker 30, and at the same time, cold air is smoothly supplied into the freezing compartment 13.

For example, the ice maker 30 may be disposed such that a surface with a small length is directed in a front and rear direction. Further, as shown in FIG. 3, when viewed from the front in a state in which the freezing compartment door 22 is open, a portion of the discharge port 153 is exposed in a lateral direction in a state in which the ice maker 30 is mounted. Therefore, cold air discharged from the discharge port 153 may be supplied to the ice maker 30, and simultaneously, supplied into the freezing compartment 13.

In addition, a discharge grille 423 serving as an outlet of a cover passage 420 to be described below may be visible at a location above a front surface of the ice maker 30, and cold air may be supplied toward the freezing compartment door 22 and the door basket 221.

Hereinafter, an internal structure of the freezing compartment 13 will be described in more detail with reference to drawings.

Figure 4:
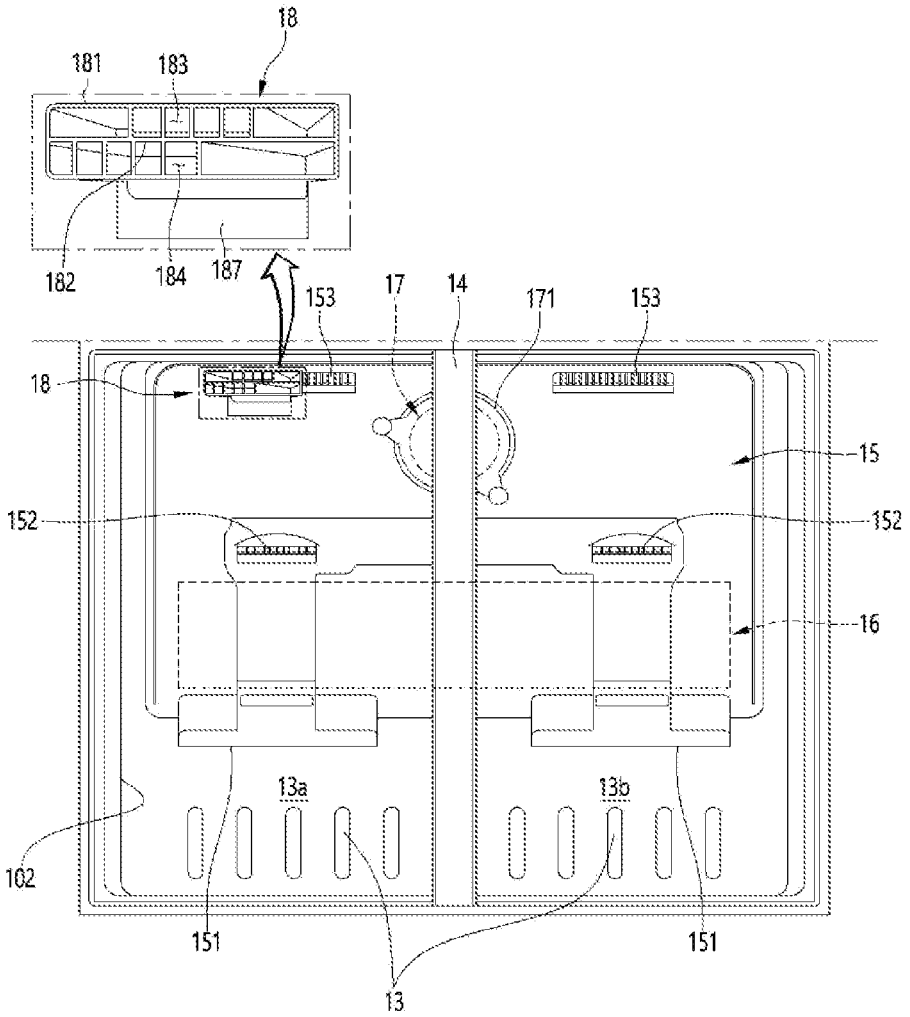
FIG. 4 is a front view showing the inside of a lower storage space of the refrigerator.
Figure 5:
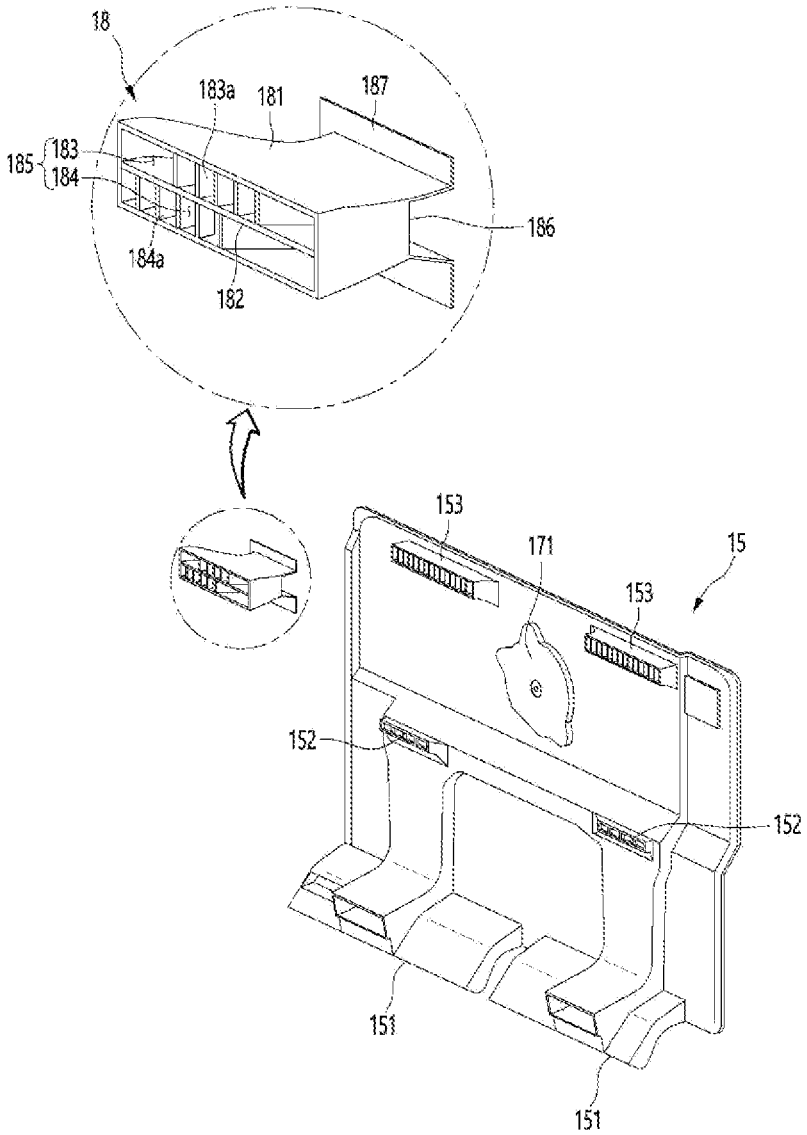
FIG. 5 is an exploded perspective view of a grille panel and a guide duct according to an implementation of the present disclosure.
Figure 6:
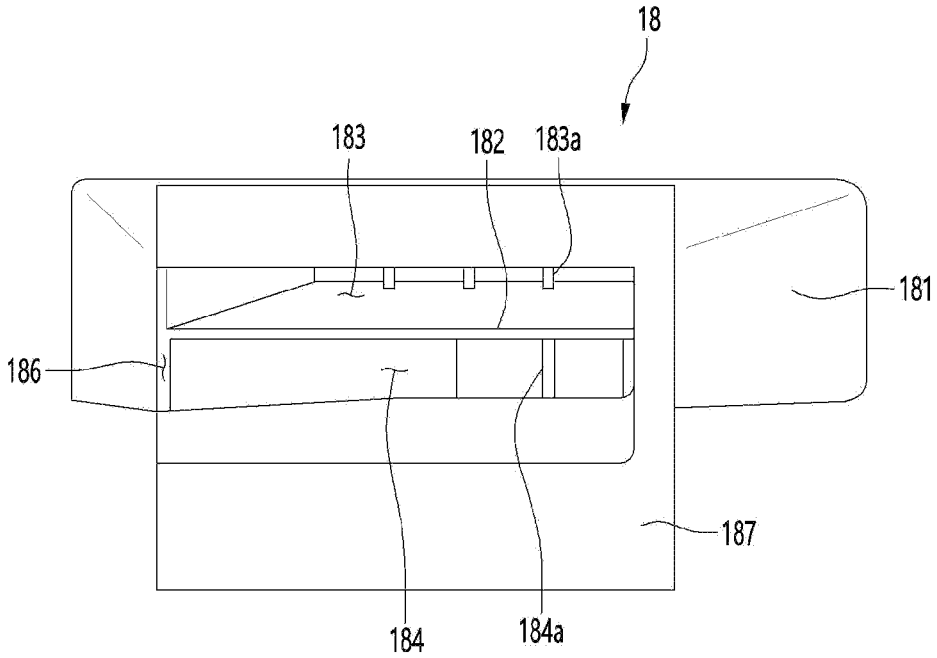
FIG. 6 is a rear view of the guide duct.

FIG. 4 is a front view showing the inside of a lower storage space of the refrigerator. In addition, FIG. 5 is an exploded perspective view of a grille panel and a guide duct according to an implementation of the present disclosure. In addition, FIG. 6 is a rear view of the guide duct.

As shown in the drawing, the freezing compartment 13 may be formed by the inner casing 102. In addition, at least a portion of a rear surface of the freezing compartment 13 may be formed by a grille panel 15.

The grille panel 15 may be formed in a plate shape and may shield an evaporator 16 disposed at the rear. That is, the grille panel 15 may divide a space of the freezing compartment 13 formed by the inner casing 102 in the front and rear direction, and may define a space in which the evaporator 16 may be accommodated.

A space of the freezing compartment 13 in front of the grille panel 15 may be divided into the left space 13*a* and the right space 13*b* by the freezing compartment barrier 14. In this regard, the left space 13*a* and the right space 13*b* may be connected to each other in a state in which cold air may flow via the space at the rear of the grille panel 15. In one example, when necessary, the left space 13*a* and the right space 13*b* may have a structure capable of independent temperature adjustment.

A blowing fan 17 may be disposed above the evaporator 16. That is, cold air generated by the evaporator 16 may be supplied to the freezing compartment 13 by driving the blowing fan 17. The blowing fan 17 may be accommodated inside a fan guide 171, and the fan guide 171 may guide suction and discharge of cold air of the evaporator 16 to be effectively performed when the blowing fan 17 rotates. The blowing fan 17 and the fan guide 171 may be disposed at a center of the grille panel 15, and may be constructed such that cold air is supplied to each of the left space 13*a* and the right space 13*b*.

A suction port 151 and a discharge port 153 may be formed on the grille panel 15, cold air may be discharged into the freezing compartment 13 via the discharge port 153, and air inside the freezing compartment 13 may be sucked to a side of the evaporator 16 via the suction port 151.

In detail, the discharge port 153 may be located at an upper end of the grille panel 15 or at an upper portion close to the upper end. The discharge port 153 may include multiple discharge ports, and may be formed long in the horizontal direction. In particular, at least some of the discharge ports 153 may be located at positions facing the ice maker 30.

For example, the discharge port 153 may be located at the rear of the ice maker 30. In addition, when viewed from the front, a portion of the discharge port 153 may be obscured by the ice maker 30, and the remaining portion thereof may further protrude in a lateral direction than the ice maker 30 and be exposed.

An intermediate discharge port 152 may be further formed at an approximate midpoint of a vertical dimension of the grille panel 15. The intermediate discharge port 152 may be formed upwardly of an upper end of the evaporator 16 and downwardly of the ice maker 30. Accordingly, an area where the freezing compartment accommodation member 131 is disposed may be mainly cooled. The intermediate discharge port 152 may also be disposed in each of the left space 13*a* and the right space 13*b*, or may be disposed at an approximate midpoint in the left and right direction.

The suction port 151 may be formed at a lower end of the grille panel 15. The suction port 151 may be located at the position of the evaporator 16 or downwardly of the evaporator 16, and may be a passage through which the air inside the freezing compartment 13 is sucked. The suction port 151 may also be disposed in each of the left space 13*a* and the right space 13*b*, or may be disposed at an approximate midpoint in the left and right direction.

In addition, a flow guide structure for a flow of cold air generated by the evaporator 16 and distribution of the cold air to the left and right spaces may be further formed at the rear of the grille panel 15.

In one example, a guide duct 18 may be disposed between the discharge port 153 and the ice maker 30. The guide duct 18 is for supplying a portion of cold air discharged from the discharge port 153 to the ice maker 30. The guide duct 18 defines a cold air flow passage from the discharge port 153 to the ice maker 30.

The guide duct 18 may be fixedly mounted to the discharge port 153. To this end, the discharge port 153 may be formed to protrude forward from the grille panel 15 and may be formed on a protruding front surface of the grille panel 15.

A rear end of the guide duct 18 may be fixed to the grille panel 15, and a front end of the guide duct 18 may be adjacent to the ice maker 30 and a top cover 40. In one example, the front end of the guide duct 18 may be coupled to or be in contact with the ice maker 30 and the top cover 40 so as to be airtight.

The guide duct 18 may include a duct body 181 that is open. The duct body 181 may define a passage 185 for guiding cold air discharged from the discharge port 153. In detail, an inner space of the duct body 181 may be partitioned in the vertical direction by a duct partition 182, an upper space partitioned by the duct partition 182 may define an upper passage 183, and a lower space partitioned by the duct partition 182 may define a lower passage 184. That is, an opened front surface of the genital duct body 181 may define a passage branched in the vertical direction.

The upper passage 183 may guide cold air to the cover passage 420, and an opened front surface of the upper passage 183 may be defined to face a cover passage inlet 420*a*. Accordingly, a portion of cold air discharged from the discharge port 153 may be supplied to the cover passage 420 via the upper passage 183.

The lower passage 184 may guide cold air to the ice maker 30, and an opened front surface of the lower passage 184 may be defined to face an ice maker inlet 135. Accordingly, a portion of cold air discharged from the discharge port 153 may be supplied to the ice maker 30 via the lower passage 184.

In one example, the duct body 181 may be formed such that a width thereof increases in a forward direction. That is, cold air discharged from the discharge port 153 may be evenly supplied to the entire inside of the cover passage 420 and the ice maker 30.

In addition, an upper grille 183*a* for partitioning the opened front surface of the upper passage 183 into multiple spaces may be formed on the opened front surface of the upper passage 183. The upper grille 183*a* may extend vertically, and may include multiple upper grilles 183*a* arranged at a regular spacing. In addition, at least some of the upper grilles 183*a* may be inclined, and thus, cold air discharged from the upper passage 183 may be guided toward the cover passage 420. At least some of the upper grilles 183*a* may extend in the front and rear direction along an inner side of the upper passage 183, and may be inclined toward the cover passage inlet 420*a* forwardly.

In one example, a lower grille 184*a* for partitioning the opened front surface of the lower passage 184 into multiple spaces may be formed on the opened front surface of the lower passage 184. The lower grille 184*a* may extend vertically, and may include multiple lower grilles 184*a* arranged at a regular spacing. In addition, at least some of the lower grilles 184*a* may be inclined, and thus, cold air discharged from the lower passage 184 may be guided toward the ice maker inlet 135. At least some of the lower grilles 184*a* may extend in the front and rear direction along an inner side of the lower passage 184, and may be inclined toward the ice maker inlet 135 forwardly.

In this regard, the upper grille 183*a* and the lower grille 184*a* may extend obliquely in different directions and may be formed to have different inclinations. That is, cold air may be effectively guided by the upper grille 183*a* and the lower grille 184*a* toward the cover passage inlet 420*a* and the ice maker inlet 135, which are opened at different positions and have different sizes.

In one example, the guide duct 18 may include a duct edge 187. The duct edge 187 enables the guide duct 18 to be fixedly mounted to the grille panel 15. The duct edge 187 may extend outward from a rear end of the duct body 181. Therefore, when the guide duct 18 is mounted onto the grille panel 15, the duct edge 187 may come into close contact with the front surface of the grille panel 15, so that the guide duct 18 may be stably mounted.

Further, a discharge port-receiving portion 186 may be defined at one end of each of the duct edge 187 and the duct body 181. The discharge port-receiving portion 186 may be opened such that a portion of the discharge port 153 is inserted into the guide duct 18. In detail, a vertical dimension of an opened rear end of the duct body 181 may correspond to a vertical dimension of the discharge port 153, so that the discharge port 153 may be inserted via an open rear surface of the duct body 181. In addition, one of left and right sides of each of the duct body 181 and the duct edge 187 may be opened, so that a portion of the discharge port 153 having a horizontal length greater than that of the guide duct 18 may be visible from the outside. In this regard, a side surface among left and right side surfaces of the duct body 181 opposite to the discharge port-receiving portion 186 supports one side surface of the discharge port 153.

As such, the discharge port 153 may be inserted into the opened rear surface of the guide duct 18. In this regard, the discharge port-receiving portion 186 may accommodate the portion of the discharge port 153 therein, and the duct edge 187 may be in close contact with the front surface of the grille panel 15, so that the guide duct 18 may maintain a stable mounted state. In addition, only a portion of cold air discharged from the discharge port 153 to the freezing compartment 13 may be supplied to the ice maker 30 by the guide duct 18.

Hereinafter, an ice making device 2 disposed in the freezing compartment 13 will be described in more detail with reference to drawings.

Figure 7:
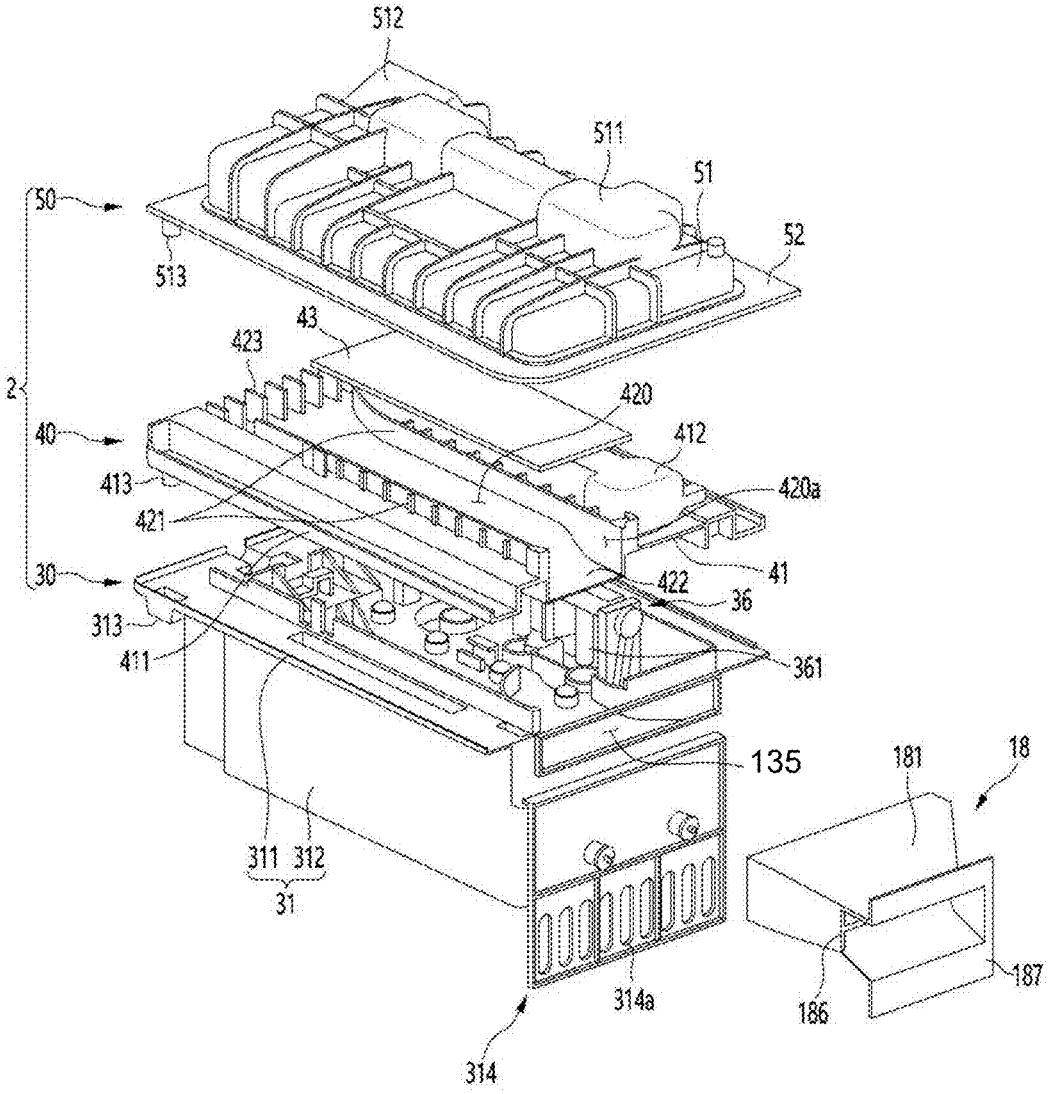
FIG. 7 is an exploded perspective view of an ice making device according to an implementation of the present disclosure.
Figure 8:
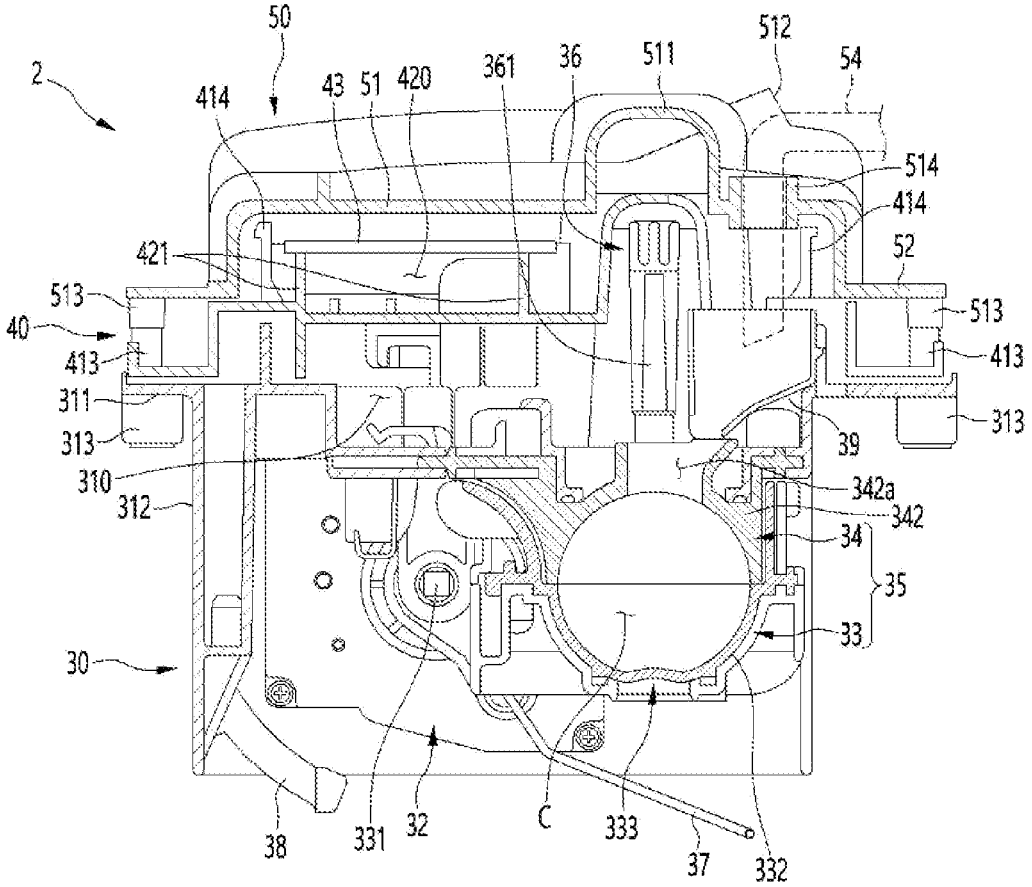
FIG. 8 is a longitudinal cross-sectional view of the ice making device.
Figure 9:
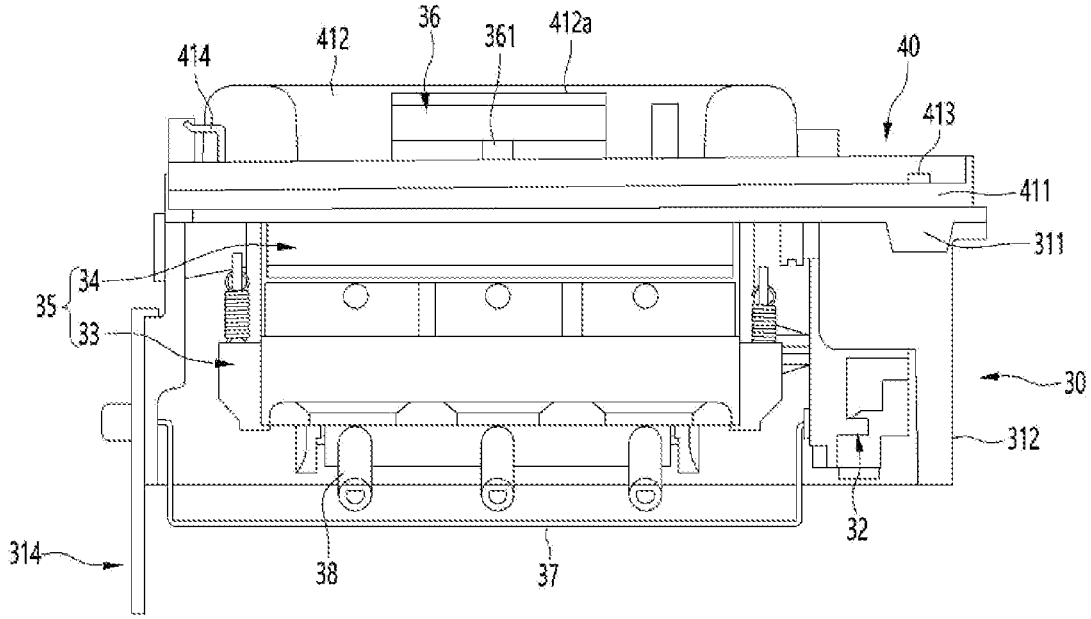
FIG. 9 is a side view in which the ice maker and the top cover according to an implementation of the present disclosure are coupled to each other.

FIG. 7 is an exploded perspective view of an ice making device according to an implementation of the present disclosure. In addition, FIG. 8 is a longitudinal cross-sectional view of the ice making device. In addition, FIG. 9 is a side view in which the ice maker and the top cover according to an implementation of the present disclosure are coupled to each other.

As shown in the drawing, the ice making device 2 may include the ice maker 30, and may further include components for operating and mounting the ice maker 30.

For example, the ice making device 2 may include the ice maker 30 for making ice and the top cover 40 for shielding a top surface of the ice maker 30. In addition, the ice making device 2 may further include a mounting cover 50 coupled to the top cover 40, so that the ice maker 30 is mounted on the barrier 11.

The ice maker 30 receives supplied water, makes ice, and then transfers the ice downward. The ice maker 30 may be an automatic ice maker in which the processes of supplying water, making ice, and transferring ice are automatically performed.

The ice maker 30 may include a casing 31 forming an outer appearance, an ice tray 35 disposed inside the casing 31 and having multiple cells C in which water is accommodated to make ice, and a driver 32 for rotating the ice tray 35. In addition, the ice maker 30 may further include an ejector 36 for removing the ice from the ice tray 35.

Each component of the ice maker 30 will be described in more detail. The casing 31 may be made of a plastic material, and may form the outer appearance of the ice maker 30, and at the same time, provide a space to accommodate the ice tray 35 therein.

The casing 31 may include a casing top surface 311 forming a top surface and a casing peripheral surface 312 extending downward along a perimeter of the casing top surface 311. The ejector 36 may transfer in the vertical direction on the casing top surface 311 to push and transfer the ice inside the cell C. In addition, the ice tray 35 and the driver 32 may be disposed inwardly of the casing peripheral surface 312.

The casing top surface 311 may form a surface that intersects the casing peripheral surface 312, and may extend outwardly of the casing peripheral surface 312. In addition, the perimeter of the casing top surface 311 may be coupled to the plate edge 411 of the top cover 40. That is, the casing top surface 311 may be shielded by the top cover 40.

In addition, an upper tray 34 for forming an upper portion of the ice tray 35 may be fixedly mounted on the casing top surface 311. The upper tray 34 may form an upper portion of the cell C. For example, the cell C may be formed in a spherical shape to make spherical ice, and multiple hemispherical grooves opening downward may be defined in a bottom surface of the upper tray 34.

In addition, a tray hole 342*a* may be defined at an upper end of the upper tray 34. The tray hole 342*a* may extend upward and not be covered with the casing top surface 311 so as to be exposed. The ejector 36 may enter and exit via the tray hole 342*a* to push and eject the ice made in the cell C.

At least one of the tray holes 342*a* may be connected to a water supply member 39 through which water is supplied, and may be a passage through which water for ice making is supplied to the multiple cells C. The water supply member 39 may be formed in a cup shape with an open top surface, and a water supply pipe 54 introduced into the barrier 11 may be disposed above the water supply member 39. The water supply member 39 may allow water to be supplied to a cell disposed in the middle among the multiple cells C, and may be disposed in the middle based on a horizontal length, that is, a length in the left and right direction, of the ice tray 35.

In addition, the ice tray 35 may include a lower tray 33 disposed beneath the upper tray 34 to form a lower portion of the ice tray 35. The lower tray 33 may be coupled to the upper tray 34 to form a lower portion of the cell C. Accordingly, multiple hemispherical grooves opening upward may be defined in a top surface of the lower tray 33.

When the upper tray 34 and the lower tray 33 are coupled to each other, the groove defined in the upper tray 34 and the groove defined in the lower tray 33 may be connected to each other to form the spherical cell C. The multiple cells C may be formed, and the multiple cells may be disposed in a row in succession. That is, an arrangement direction of the cells C may be continuous in the front and rear direction when viewed from the front, the arrangement direction of the cells C may be a direction parallel to a flow direction of cold air discharged from the discharge port 153, and the cells may be arranged in succession in the same direction as an extending direction of the cover passage 420 to be described below.

The lower tray 33 may be rotatably mounted on the driver 32. A rotation shaft 331 of the lower tray 33 may be coupled to the driver 32, and the lower tray 33 may rotate to open the cell C to allow the made ice to fall.

In one example, at least a portion of each of the upper tray 34 and the lower tray 33 may be made of a material that is elastically deformable such as rubber or silicone so as to have each of an upper body 342 and a lower body 332. For example, the upper body 342 and the lower body 332 for forming the cell C of the upper tray 34 and the lower tray 33 may be at least made of a rubber or silicon material. Therefore, when the lower tray 33 comes into contact with the upper tray 34 by rotation, the upper body 342 and the lower body 332 come into close contact with each other to prevent water from leaking, and to make the ice transfer smoother. The remaining portions of the upper tray 34 and the lower tray 33 may be made of a plastic or metal material to provide a structure capable of being coupled to other components and operating.

In some implementations, the driver 32 may be formed by a combination of a rotating motor and multiple gears for connecting the motor and the rotation shaft 331 to each other. In addition, the ejector 36 and a full ice detection device 37 to be described below may be connected to the driver 32, and the ejector 36 and the full ice detection device 37 may be operated by the operation of the driver 32.

The ejector 36 may be operated to transfer the ice made inside the cell C. The ejector 36 may be disposed on the top surface of the casing 31, and may be connected to the driver 32 to reciprocate in the vertical direction in association with the operation of the lower tray 33. Accordingly, when the ice making is completed and the lower tray 33 rotates, the cell C is opened, and an ejecting rod 361 passes through the tray hole 342*a* to push and eject the ice.

In addition, a lower ejector 38 may be further disposed inwardly of the casing peripheral surface 312. The lower ejector 38 may protrude inward from a front surface of the casing 31. In addition, a protruding end of the lower ejector 38 may be disposed within a radius of rotation of the lower casing 31 and extend to press one side of the lower casing 31, more specifically, a portion corresponding to one side of the cell C when the lower casing 31 is rotated.

Specifically, when the lower tray 33 is rotated to open the cell C, the ice is discharged by the ejector 36, but when the ice is positioned on the lower tray 33, the fixed lower ejector 38 is able to discharge the ice by pressing one side of the lower tray 33 corresponding to a lower portion of the cell C by the rotation of the lower tray 33. In this regard, a portion of the lower tray 33 in contact with the lower ejector 38 may be formed to be elastically deformable.

In one example, heaters may be further disposed in the upper tray 34 and the lower tray 33. The heaters may heat the upper tray 34 and the lower tray 33 such that the ice may be more easily removed from the cell C when the ice making is completed.

In one example, the full ice detection device 37 may be rotated below the lower tray 33, and both ends of the full ice detection device 37 may be coupled to the casing 31. The full ice detection device 37 may rotate based on the operation of the driver 32 such that ice located below the ice tray 35 may be detected.

That is, when the made ice accumulates to a vertical level equal to or greater than a certain vertical level in the ice bin 60 disposed below the ice tray 35, such state may be detected by the full ice detection device 37, and additional ice making operation of the ice maker 30 may be stopped.

A rear surface of the casing peripheral surface 312 may be open, and the other side surface and front and rear surfaces excluding one side surface thereof may extend downward from the casing top surface 311 to cover the ice tray 35 so as not to be exposed. That is, one side surface of the casing 31 facing a side wall of the storage space may be opened, and the rest of the peripheral surface may be shielded. In addition, a space opened downward and in which the ice tray 35 and the driver 32 may be disposed may be defined by the casing top surface 311 and the casing peripheral surface 312.

In one example, an ice maker inlet 135 through which cold air flows into the ice maker 30 may be defined at an upper end of a rear surface of the casing 31. The ice maker inlet 135 may be opened at an upper end of the casing peripheral surface 312 and may be extended to both left and right sides.

The ice maker inlet 135 may be defined to face the guide duct 18. In particular, the ice maker inlet 135 may be defined at a position corresponding to an outlet of the lower passage 184 and may have a size corresponding to the outlet of the lower passage 184. The ice maker inlet 135 may have a structure adjacent to or connected to the outlet of the lower passage 184, so that cold air discharged through the lower passage 184 may be supplied into the ice maker 30 via the ice maker inlet 135.

The ice maker inlet 135 may be positioned at a vertical level corresponding to an upper portion or a top surface of the upper tray 34, and thus, cold air introduced into the ice maker inlet 135 may cool the upper tray 34. In addition, cold air introduced into the ice maker 30 may flow downwardly inside the casing border 312 to also cool an area of the lower tray 33.

In addition, a shielding plate 314 may be further formed on the casing border 312. The shielding plate 314 may be mounted on the rear surface of the casing border 312 and may extend downwardly of a lower end of the casing border 312. The casing border 312 may shield at least a portion of a space between a rear end of the ice maker 30 and a rear end of the ice bin 60, and prevent ice from falling to a space at the rear of the ice bin 60 when the ice bin 60 is retracted and extended.

Further, a ventilation hole 314*a* through which cold air may flow through the shielding plate 314 may be defined in the shielding plate 314. Cold air passing through the ventilation hole 314*a* may cool a lower portion of the ice maker 30 and may be supplied into the ice bin 60 to cool stored ice.

In one example, the top cover 40 may be mounted on the top surface of the ice maker 30. The top cover 40 may be coupled to the casing top surface 312 of the ice maker 30. For example, a casing coupling portion 313 may be formed at a corner of the casing top surface 312 and may be coupled with a top cover coupling portion 413 formed at a corner of the top cover 40.

The top cover 40 may shield a space above the ice maker 30. In addition, in the state in which the top cover 40 is mounted on the ice maker 30, an ice maker passage may be defined between the top cover and the ice maker. The ice maker passage may define an ice maker passage 310 through which cold air introduced into the ice maker inlet 135 flows. Therefore, cold air introduced into the ice maker inlet 135 may cool water inside the ice tray 35 while passing through the ice maker passage 310 to make ice.

In addition, the cover passage 420 that allows a portion of cold air discharged from the discharge port 153 to flow forward bypassing the ice maker 30 may be defined in a top surface of the top cover 40. In addition, an ejector accommodating portion 412 that defines a space for the vertical movement of the ejector 36 therein may be defined in the top cover 40. A detailed structure of the top cover 40 will be described in more detail below.

In addition, the mounting cover 50 may be disposed on the top surface of the top cover 40. The mounting cover 50 may shield a barrier opening 102*a* defined in a bottom surface of the barrier 11 and may accommodate an upper portion of the top cover 40 therein. In addition, the mounting cover 50 is coupled to the top cover 40 and the ice maker 30, so that the ice maker 30 may be mounted on the bottom surface of the barrier 11. Accordingly, the mounting cover 50 may be referred to as a mounting bracket.

Hereinafter, a structure of the mounting cover 50 will be described in more detail with reference to drawings.

Figure 10:
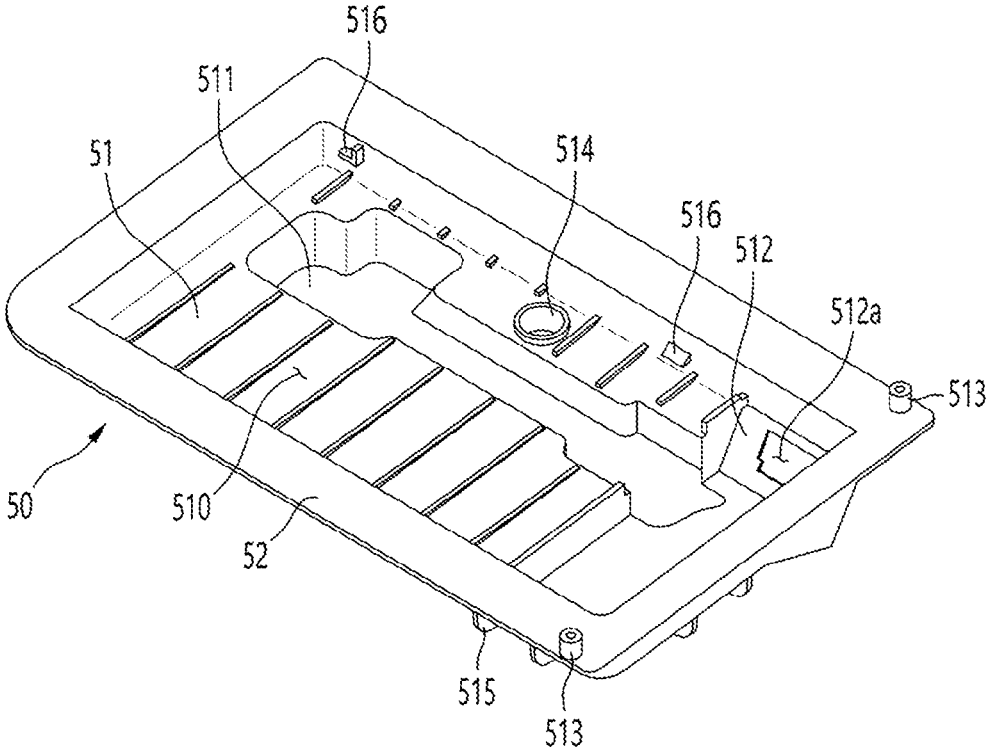
FIG. 10 is a perspective view showing a bottom surface of a mounting cover according to an implementation of the present disclosure.

FIG. 10 is a perspective view showing a bottom surface of a mounting cover according to an implementation of the present disclosure.

As shown in the drawing, the mounting cover 50 may include a mounting plate 51 made of a plastic material and formed in a plate shape to define a recessed space 510 therein, and a mounting edge 52 formed along a perimeter of the mounting plate 51.

The mounting plate 51 may be formed in a shape corresponding to the shape of the top cover 40, and may define the recessed space 510 for receiving the upper portion of the top cover 40 therein. In particular, a mounting accommodating portion 511 may be further recessed to accommodate the ejector accommodating portion 412 therein at a position corresponding to the ejector accommodating portion 412.

In addition, a connector mounting portion 512 in which a connector to which a wire for operating the ice maker 30 is connected is mounted may be formed to protruded at one side of the mounting plate 51. A connector hole 512*a* extending through the connector mounting portion 512 may be defined in the connector mounting portion 512.

A water supply pipe receiving port 514 may be formed on the mounting plate 51. The water supply pipe 54 for supplying water to the cell C of the ice tray 35 may pass through the water supply pipe receiving port 514. The water supply pipe 54 inserted to pass through the water supply pipe receiving port 514 may extend to the water supply member 39 and supply water to the water supply member 39.

In addition, multiple reinforcing ribs 515 may be formed on a top surface of the mounting plate 51. The reinforcing ribs 515 may be formed over an entire area of the mounting plate 51, and the multiple reinforcing ribs 515 may be disposed to intersect each other. The top surface of the mounting plate 51, as a portion inserted into the barrier opening 102*a*, may prevent the mounting plate 51 from being deformed by a pressure of a foam insulation material 103 injected into the barrier 11.

The mounting edge 52 may extend outwardly along a perimeter of a lower end of the mounting plate 51.

The mounting edge 52 may come into contact with a perimeter of the barrier opening 102*a* defined in the bottom surface of the barrier 11. That is, the mounting cover 50 may be mounted such that the mounting plate 51 is inserted into the barrier opening 102*a* and the mounting edge 52 is in close contact with the bottom surface of the barrier 11. Accordingly, in the state in which the ice making device 2 is mounted on the barrier 11, a portion of each of the mounting cover 50 and the top cover 40 may be located in an inner area of the barrier 11. In addition, the water supply pipe 54 guided into the barrier 11 may be mounted to pass through the water supply pipe receiving port 514 of the mounting cover 50.

In one example, the mounting edge 52 may come into contact with a perimeter of the top cover 40. In addition, a mounting coupling portion 513 coupled to the top cover coupling portion 413 may be formed at a corner of the mounting edge 52. Accordingly, the casing coupling portion 313, the top cover coupling portion 413, and the mounting coupling portion 513 may be sequentially coupled to each other and may be firmly coupled to each other via screws.

That is, the mounting cover 50 may be coupled to the top cover 40, and eventually, the ice maker 30, the top cover 40, and the mounting cover 50 may be fixedly mounted on the bottom surface of the barrier 11 in the state of being coupled to each other.

In one example, the mounting cover 50 may be omitted when necessary, and the bottom surface of the barrier 11 may be recessed to be formed in the same shape as the mounting cover 50 and the top cover 40 may be directly mounted on the barrier 11.

Hereinafter, a structure of the top cover 40 will be described in more detail with reference to the drawings.

Figure 11:
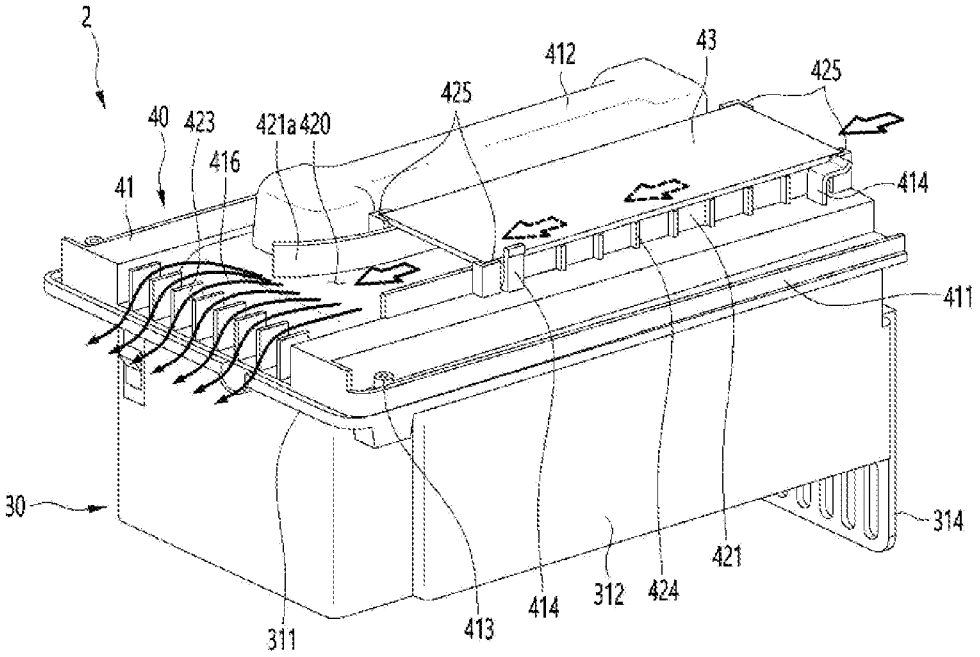
FIG. 11 is a perspective view in which the ice maker and the top cover are coupled to each other.
Figure 12:
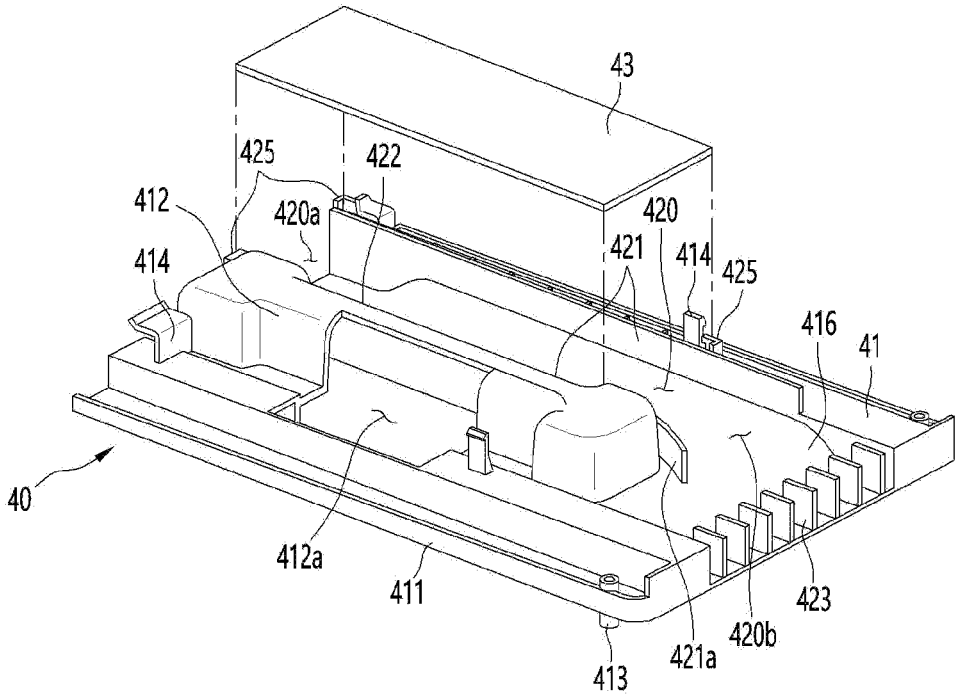
FIG. 12 is an exploded perspective view of the top cover.
Figure 13:
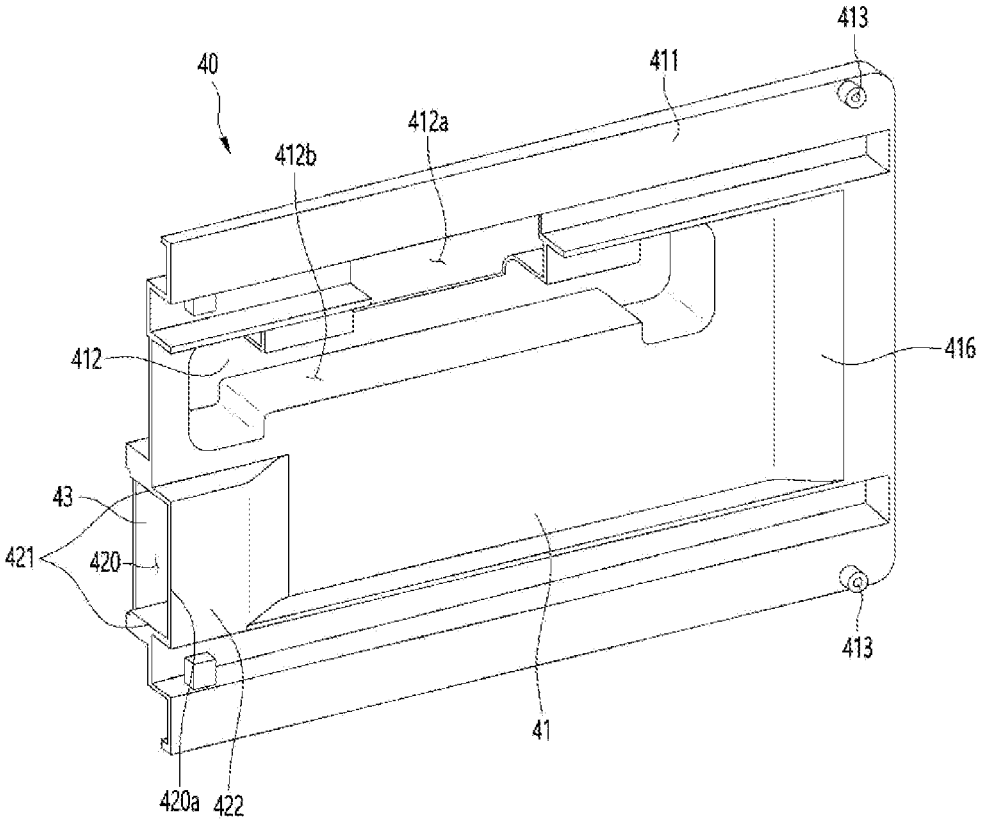
FIG. 13 is a perspective view showing a bottom surface of the top cover.

FIG. 11 is a perspective view in which the ice maker and the top cover are coupled to each other. In addition, FIG. 12 is an exploded perspective view of the top cover. In addition, FIG. 13 is a perspective view showing a bottom surface of the top cover.

As shown in the drawing, the top cover 40 may be coupled to the casing top surface 311 and may be constructed to shield the top surface of the ice maker 30 from above.

The top cover 40 may be formed in a size corresponding to that of the casing top surface 311, and may be injection-molded with a plastic material. The top cover 40 is coupled to the casing top surface 312 to shield the top surface of the ice maker 30, and simultaneously, define the cold air flow passage inside the ice maker 30, that is, the ice maker passage 310.

The top cover 40 may be injection-molded with the plastic material, and may define the ice maker passage 310 and the cover passage 420 while shielding the top surface of the ice maker 30.

The top cover 40 may include a cover plate 41 formed in a plate shape and shielding the top surface of the ice maker 30, and a plate edge 411 extending upward along a perimeter of the cover plate 41.

The cover plate 41 may be formed to have a size corresponding to a size of the top surface of the ice maker 30. Accordingly, a bottom surface of the cover plate 41 may be coupled to the top surface of the casing 31, and may shield the top surface of the ice maker 30 in the coupled state. In addition, the cover coupling portion 413 may be formed at a corner of the cover plate 41 and may be coupled to the casing coupling portion 313 and the mounting coupling portion 513.

In addition, the ejector accommodating portion 412 may be defined in the cover plate 41 at the position corresponding to the ejector 36. The ejector accommodating portion 412 may define a space 412*b* having an open bottom surface and recessed upward. Accordingly, in the state in which the top cover 40 is mounted on the ice maker 30, the space in which the ejector 36 may move in the vertical direction may be provided.

In addition, a cover opening 412*a* may be defined in the cover plate 41. The cover opening 412*a* may be defined to extend through the cover plate 41 at a position corresponding to the water supply member 39, and may be defined such that the water supply member 39 is disposed therein. The cover opening 412*a* may be defined by cutting portions of the ejector accommodating portion 412 and the cover plate 41.

In one example, a fastening member 414 extending upward may protrude from the cover plate 41. The fastening member 414 may be formed in a hook-like shape and may be coupled to a fastening portion 516 formed on an inner surface of the mounting cover 50.

Multiple fastening members 414 may be formed on the cover plate 41, and may have different shapes as needed, thereby providing a structure in which the mounting cover 50 and the top cover 40 are more firmly coupled to each other and are easily detachable from each other.

In addition, a side rib 421 for defining the cover passage 420 may be formed on the cover plate 41. The cover passage 420 may include a pair of side ribs 421 and an insulating plate 43 for connecting upper ends of the side ribs 421 to each other.

In detail, the side rib 421 may be integrally molded during the injection-molding of the top cover 40. In addition, the side rib 421 may extend forward from a rear end of the cover plate 41. The pair of side ribs 421 may be disposed on both left and right sides, and the cover passage 420 may be defined in a space between the side ribs 421 spaced apart from each other.

In addition, the side rib 421 may extend vertically upward from the top surface of the cover plate 41. In addition, a protruding height of the side rib 421 may be a height that does not interfere with the mounting cover 50.

In addition, the multiple reinforcing ribs 515 may be formed on the side rib 421. The multiple reinforcing ribs 515 may be formed on an entire outer surface of the side rib 421, and may be arranged at a regular spacing.

The side rib 421 may extend to a position away from a front end of the cover plate 41. In addition, the side rib 421 may extend forwardly of a front end of the ejector accommodating portion 412. For example, the side rib 421 may extend to an outlet guide 416 formed at the front end of the cover plate 41.

The side ribs 421 disposed on both left and right sides may extend forward while maintaining a predetermined spacing therebetween. In addition, the distance between the pair of side ribs 421, that is, a width of an open front surface of the cover passage 420 may be greater than a width of a rear surface of the cover passage 420. That is, front portions of the side ribs 421 may be formed such that a distance therebetween gradually increases forwardly. Therefore, cold air discharged from the cover passage 420 may be discharged while spreading more widely to cool a wide area in front of the ice maker 30.

In one example, an inlet guide 422 recessed downward may be defined at a bottom surface of a front end of the side rib 421, that is, a front end of the cover passage 420. The inlet guide 422 may be defined to be inclined or rounded upwardly in the forward direction. In addition, a structure in which lower ends of the side ribs 421 are respectively connected to both side ends of the inlet guide 422. Accordingly, the cover passage inlet 420*a* may secure a sufficient inlet size, and cold air introduced from the guide duct 18 may be effectively introduced into the cover passage 420.

The opened rear surface of the cover passage 420, that is, the cover passage inlet 420*a* may be located above the ice maker inlet 135. In this regard, a width in the left and right direction of the cover passage inlet 420*a* may be smaller than a width in the left and right direction of the ice maker inlet 135.

The cover passage inlet 420*a* and the ice maker inlet 135 may be arranged in the vertical direction, and a lower end of the cover passage inlet 420*a* and an upper end of the ice maker inlet 135 may be arranged so as to be in contact with each other. Therefore, cold air supplied in a branched manner via the guide duct 18 may flow into the cover passage 420 and the ice maker 30 in a state of facing an outlet of the guide duct 18 branched in the vertical direction.

A plate mounting portion 425 that allows the insulating plate 43 to be mounted may be formed at an upper end of the side rib 421. The plate mounting portion 425 may protrude upward, and may be formed at each of corresponding positions so as to restrain four corners of the plate-shaped insulating plate 43. For example, the plate mounting portion 425 may be formed on each of the side ribs 421 on left and right sides, and may be formed at each of positions corresponding to front and rear ends of the insulating plate 43.

In one example, the insulating plate 43 may be coupled to the upper end of the side rib 421 to form a top surface of the cover passage 420. The insulating plate 43 may be formed in a plate shape and may be made of a heat insulating material. For example, the insulating plate 43 may be made of a vacuum insulating material or an expanded polystyrene (EPS) material.

The insulating plate 43 may block transfer of cold air inside the cover passage 420 in the upward direction. Therefore, even when cold air is supplied via the cover passage 420, cold air may be prevented from being transferred to the bottom surface of the refrigerating compartment 12 via the barrier 11. In particular, even when the barrier 11 is partially thinned due to the arrangement of the mounting cover 50 and the recessed structure of the accommodation portion 111, a temperature of the bottom surface of the refrigerating compartment 12 may be prevented from being lowered by the cover passage 420.

A width in the left and right direction of the insulating plate 43 may correspond to the distance between the pair of side ribs 421. In addition, a length in the front and rear direction of the insulating plate 43 may be smaller than a length of the side rib 421, and may correspond to a length of a section where the distance between the pair of side ribs 421 is constant.

The outlet guide 416 may be defined from the front end of the side rib 421 to the front end of the cover plate 41. The outlet guide 416 may be defined to be inclined or rounded downwardly in the forward direction from the front end of the side rib 421 to allow cold air discharged between the side ribs 421 to be discharged while spreading widely in the vertical direction.

The discharge grille 423 may be formed at the front end of the cover plate 41, that is, at a front end of the outlet guide 416. The multiple discharge grilles 423 may be formed along the outlet guide 416 and may be formed in succession at a regular spacing.

In addition, the discharge grille 423 may be inclined in a direction intersecting an extension line passing through a center of the cover passage 420 and extending in the front and rear direction. Accordingly, cold air discharged via the cover passage 420 may have directionality, and may be directed toward a specific position in front of the ice maker 30, for example, toward the door basket 221. In addition, the multiple discharge grilles 423 may be formed with different inclinations, so that cold air discharged by the cover passage 420 may be directed toward a plurality of areas.

Hereinafter, an operation of the refrigerator 1 having the above structure will be described in more detail with reference to drawings.

Figure 14:
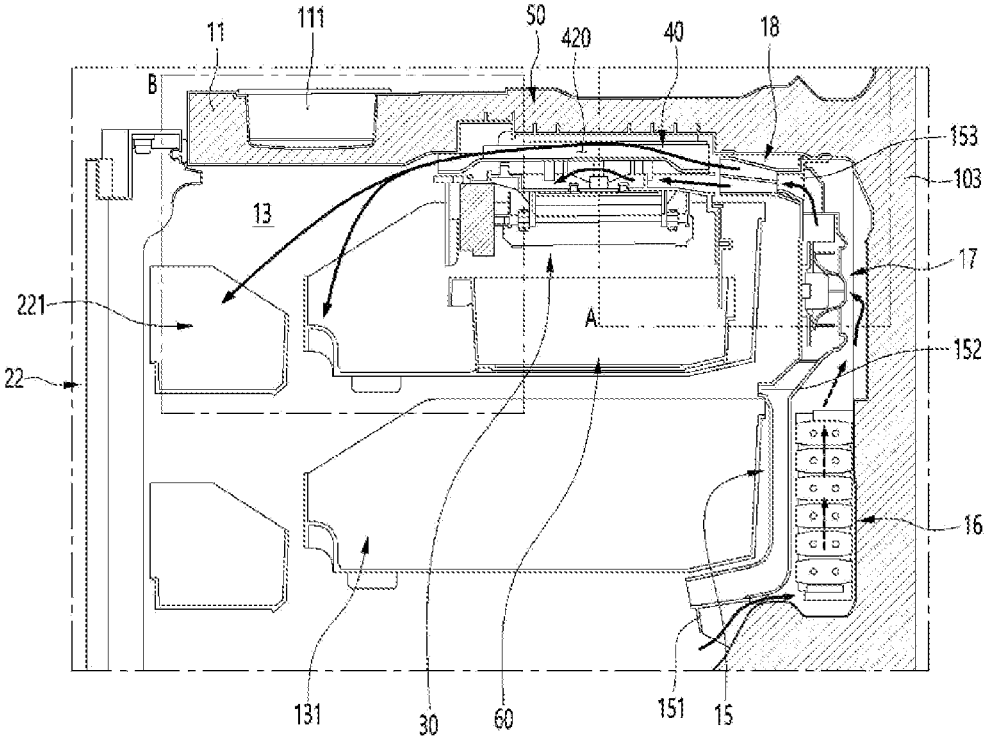
FIG. 14 is a cross-sectional view showing a flow state of cold air inside the freezing compartment.
Figure 15:
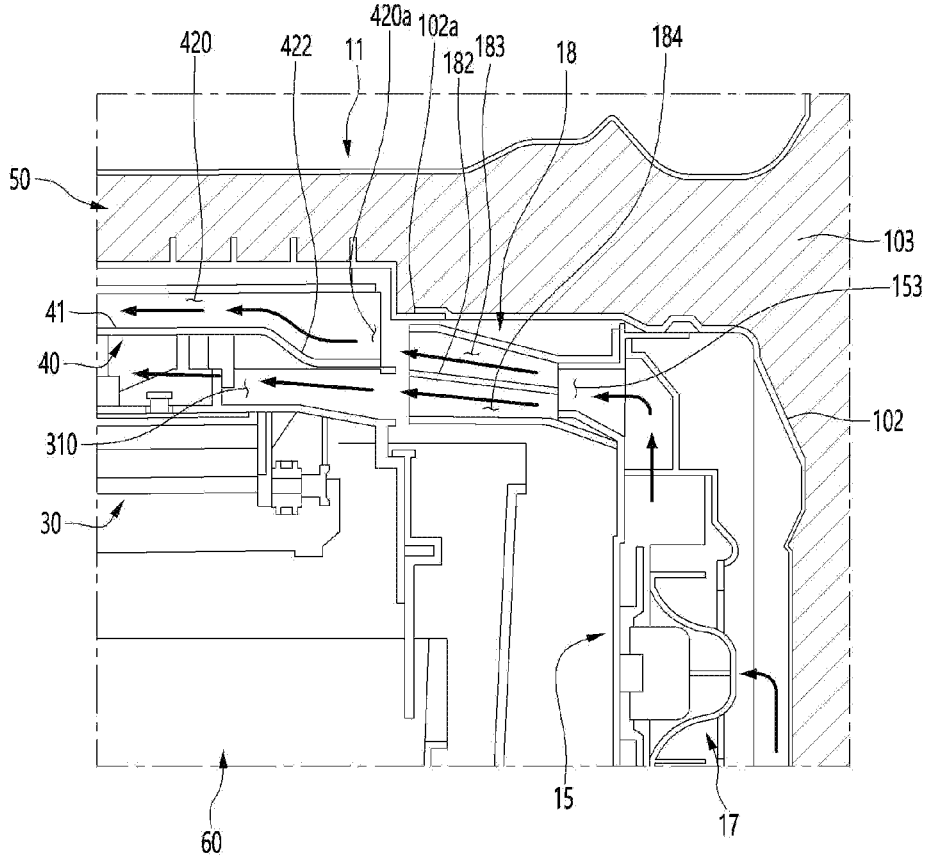
FIG. 15 is an enlarged view of a portion A in FIG. 14.
Figure 16:
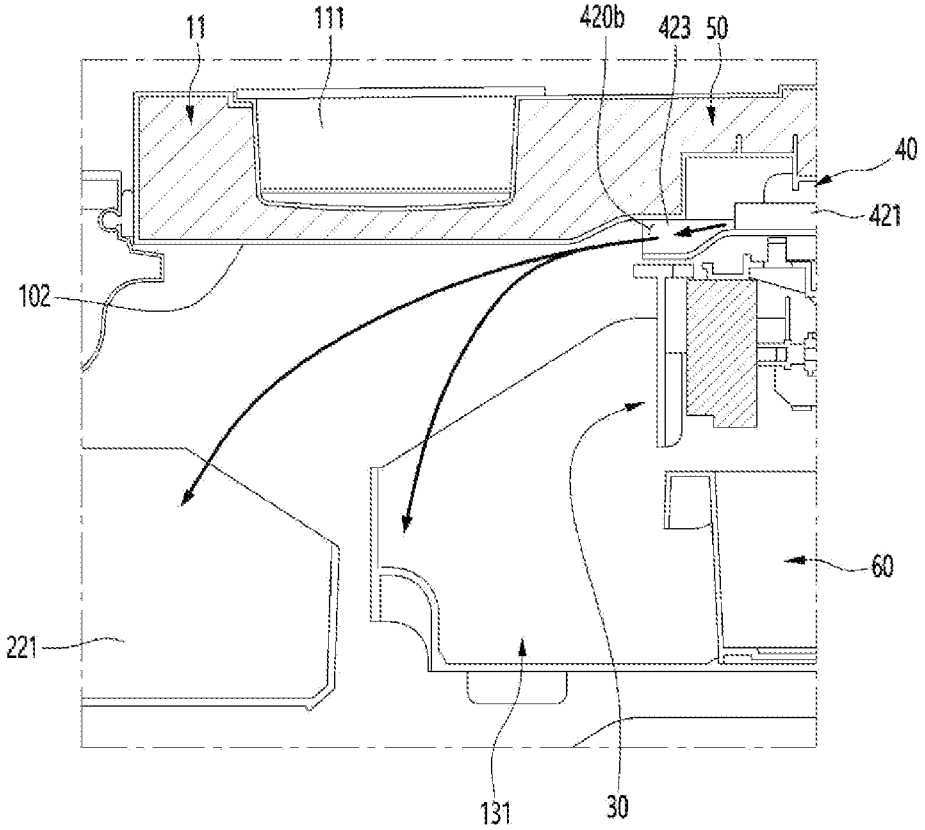
FIG. 16 is an enlarged view of a portion B in FIG. 14.

FIG. 14 is a cross-sectional view showing a flow state of cold air inside the freezing compartment. In addition, FIG. 15 is an enlarged view of a portion A in FIG. 14. In addition, FIG. 16 is an enlarged view of a portion B in FIG. 14.

As shown in the drawing, a refrigeration cycle may be driven to cool the freezing compartment 13, and cold air may be generated by heat exchange with ambient air in the evaporator 16. In such state, when the blowing fan 17 is operated, cold air generated in the evaporator 16 may be discharged into the freezing compartment 13 via the discharge port 153, and air inside the freezing compartment 13 may be sucked via the suction port 151 and flow into the evaporator 16. By such circulation of cold air, the freezing compartment 13 may be cooled to a set temperature.

In one example, the ice maker 30 may be disposed in front of the discharge port 153. The ice maker 30 may be positioned between the rear surface of the door 20 and a front surface of the grille panel 15. In addition, when viewed from the front, the portion of the discharge port 153 may not be covered by the ice making device 2 so as to be exposed in the lateral direction.

A portion of cold air discharged from the discharge port 153 may be directly exposed to the inside of the freezing compartment 13, and the remaining portion thereof may be supplied to the ice making device 2 via the guide duct 18.

In this regard, a portion of cold air supplied to the ice making device 2 via the guide duct 18 may be supplied to the ice maker 30, so that the ice maker 30 may make ice.

In addition, a portion of cold air supplied to the ice making device 2 via the guide duct 18 may bypass the ice maker 30 upwardly via the cover passage 420 of the top cover 40 and be supplied to the rear surface of the freezing compartment door 22 and the door basket 221.

Therefore, even in the state in which the discharge port 153 is obscured due to the arrangement of the ice maker 30, cold air that has bypassed the ice maker 30 via the cover passage 420 may be smoothly supplied toward the rear surface of the freezing compartment door 22 and the door basket 221 from the front surface of the ice maker 30.

This will be described in more detail. As shown in FIG. 15, cold air discharged from the discharge port 153 by the driving of the blowing fan 17 is directed forward. In addition, cold air may flow into the guide duct 18 connected to the discharge port 153. Cold air introduced into the guide duct 18 may flow forward along the branched upper passage 183 and lower passage 184.

In addition, cold air discharged forward via the lower passage 184 may be introduced into the ice maker 30 via the ice maker inlet 135. In addition, cold air introduced into the ice maker 30 cools an area corresponding to the upper portion of the cell C in the ice maker passage 310. In addition, cold air inside the ice maker passage 310 may pass through the casing top surface 311 and flow downward to cool an entirety of the ice tray 35.

As such, the ice maker 30 may cool the inside of the cell C by cold air supplied via the lower passage 184 and make spherical ice. When spherical ice is made, the lower tray 33 may be rotated by the driver 32 and the ejector 36 and the lower ejector 38 may be operated. Ice inside the cells C may be transferred downward by the ejector 36 and the lower ejector 38 and stored in the ice bin 60.

In one example, cold air discharged from the upper passage 183 of the guide duct 18 may flow into the cover passage inlet 420*a*. In addition, cold air passing through the cover passage inlet 420*a* may pass through the top surface of the top cover 40 and flow forward without passing through the area of the ice maker 30, particularly the location where the cells C are formed.

In detail, cold air discharged from the upper passage 183 may flow into the cover passage 420 through the inlet of the cover passage 420, and cold air flowing along the cover passage 420 may not pass through the ice maker 30 and may be discharged forward via the outlet of the cover passage 420. In this regard, the cover passage 420 may be defined in the top surface of the top cover 40, and may supply cold air forward such that cold air does not pass through the ice maker passage 310.

Cold air passing through a cover passage outlet 420*b* may have the directionality while passing through the multiple discharge grilles 423, and may be discharged forward. Cold air discharged via the cover passage 420 is discharged forwardly of the ice maker 30 and is directed toward a rear wall surface of the freezing compartment 13 or the door basket 221.

In one example, the bottom surface of the barrier 11 onto which the ice making device 2 is mounted may be recessed, and the bottom surface of the barrier 11 in front of the discharge grille 423 may be formed to be inclined so as to guide cold air discharged via the discharge grille 423 downward.

Therefore, cold air may be more effectively supplied to the space in front of the ice maker 30, and a cooling performance inside the freezing compartment 13 may be guaranteed. In particular, sufficient cold air may also be supplied to the door basket 221 located at the position facing the ice maker 30.

In addition, cold air passing through the cover passage 420 may be prevented from being transferred upward with the insulating plate 43. Therefore, even in the area where the thickness of the barrier 11 is reduced as the barrier 11 is recessed for mounting the ice making device 2, cold air may be prevented from being transferred upward, and the temperature of the bottom surface of the refrigerating compartment 12 may be prevented from being lowered.

INDUSTRIAL APPLICABILITY

The refrigerator according to the implementation of the present disclosure has high industrial applicability because the cold air circulation in the refrigerator may be improved and the cooling performance may be improved.

What is claimed is:

1. A refrigerator comprising:

a cabinet defining a storage space therein;

an ice maker disposed in the storage space and configured to make ice, the ice maker being disposed at a discharge port configured to discharge cold air into the storage space; and a cover disposed between the ice maker and a surface of the storage space, the cover defining (i) an ice maker passage of the cold air for making ice and (ii) a cover passage configured to guide a portion of the cold air discharged from the discharge port to bypass the ice maker and be provided to the storage space, wherein the ice maker includes:

an ice tray defining a cell configured to receive water therein to form ice, and a casing configured to accommodate the ice tray therein, the casing comprising a first surface disposed between the ice maker passage and the ice tray, and wherein the ice maker passage is defined between the cover and the casing.

2. The refrigerator of claim 1, wherein the casing further comprises a second surface extending from the first surface, wherein the ice tray is disposed within a space that is defined by the first surface and the second surface of the casing, wherein the cover is disposed on a first side of the first surface of the casing, and the second surface is disposed on a second side of the first surface opposite to the first side, and wherein a cover passage inlet configured to guide cold air into the cover passage is defined at one side of the cover that faces the discharge port.

3. The refrigerator of claim 1, further comprising a guide duct disposed between the ice maker and the discharge port, wherein an inside of the guide duct is branched, and branched outlets of the guide duct are open toward the cover passage and the ice maker passage.

4. The refrigerator of claim 1, further comprising a guide duct disposed between the ice maker and the discharge port, wherein a portion of the discharge port is shielded by the guide duct, and a remaining portion of the discharge port extends beyond an outer boundary of the ice maker and is exposed to the storage space.

5. The refrigerator of claim 1, further comprising a guide duct disposed between the ice maker and the discharge port, wherein the guide duct includes:

a duct body having first and second open surfaces; and a duct partition that partitions an inner space of the duct body to define a first passage and a second passage, wherein an outlet of the first passage is defined at a position that faces a cover passage inlet, the cover passage inlet being configured to guide cold air into the cover passage, and wherein an outlet of the second passage is defined at a position that faces an ice maker inlet, the ice maker inlet being configured to guide cold air into the ice maker passage.

6. The refrigerator of claim 5, wherein first grilles for guiding cold air discharged from the discharge port toward the cover passage are provided in the first passage, wherein second grilles for guiding cold air discharged from the discharge port into the ice maker are provided in the second passage, and wherein the first grilles and the second grilles are inclined in different directions.

7. The refrigerator of claim 5, wherein the guide duct includes a duct edge extending outward from an end of the duct body and supported on a grille panel front surface, and wherein one end of the duct edge includes a discharge port-receiving portion that is shaped to receive therein a portion of the discharge port having a protruding shape.

8. The refrigerator of claim 1, wherein the surface of the storage space defines a recessed space, and at least a portion of the cover is accommodated inside the recessed space.

9. The refrigerator of claim 1, further comprising:

a door configured to open and close at least a portion of the storage space; and a door basket disposed on a rear surface of the door, wherein an outlet of the cover passage is open toward the door basket, and wherein the ice maker is disposed in front of the discharge port.

10. A refrigerator comprising:

a cabinet defining a storage space therein;

an ice maker disposed in the storage space and configured to make ice, the ice maker being disposed at a discharge port configured to discharge cold air into the storage space; and a cover disposed between the ice maker and a surface of the storage space, the cover defining a cover passage configured to guide a portion of the cold air discharged from the discharge port to bypass the ice maker and be provided to the storage space, wherein the cover includes:

a pair of side ribs extending on a surface of the cover and spaced apart from each other; and a duct cover for connecting first ends of the side ribs to each other, wherein the cover passage is defined by the surface of the cover, the side ribs, and the duct cover, and wherein a distance between the side ribs increases in a direction toward an outlet of the cover passage.

11. The refrigerator of claim 10, wherein the duct cover is made of a plate-shaped heat insulating material.

12. The refrigerator of claim 10, wherein multiple discharge grilles protruding from the surface of the cover are provided at a space that is spaced apart from an outlet of the cover passage, and wherein the discharge grilles are inclined to intersect an extending direction of the cover passage.

13. The refrigerator of claim 12, wherein a discharge guide extending from second ends of the side ribs to the discharge grilles and inclined downward is defined in the cover.

14. A refrigerator comprising:

a cabinet comprising an inner casing, the inner casing defining a storage space therein;

an ice maker disposed in the storage space and configured to make ice, the ice maker being disposed at a discharge port that is configured to discharge cold air into the storage space;

a cover that defines an ice maker passage and a cover passage; and a guide duct disposed between the ice maker and the discharge port, wherein the ice maker includes:

an ice tray defining a cell configured to receive water therein to form ice, and a casing configured to accommodate the ice tray therein, wherein the cover comprises a cover plate disposed between the ice maker and a surface of the inner casing, wherein the ice maker passage is defined between the cover plate and the casing of the ice maker, and the cover passage is defined between the cover plate and the surface of the inner casing, and wherein an inside of the guide duct is branched, and branched outlets of the guide duct are open toward the cover passage and the ice maker passage, respectively.

15. The refrigerator of claim 14, wherein the cover shields at least a portion of an open surface of the casing, and wherein a cover passage inlet configured to guide cold air into the cover passage is defined at one side of the cover that faces the discharge port.

16. The refrigerator of claim 14, wherein a portion of the discharge port is shielded by the guide duct, and a remaining portion of the discharge port extends beyond an outer boundary of the ice maker and is exposed to the storage space.

* * * * *